US010808982B2

(12) United States Patent
Hanson

(10) Patent No.: US 10,808,982 B2
(45) Date of Patent: Oct. 20, 2020

(54) MODULAR FLIPPER MULLION RECEIVER

(71) Applicant: Electrolux Home Products, Inc., Charlotte, NC (US)

(72) Inventor: Josh Hanson, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 110 days.

(21) Appl. No.: 15/835,900

(22) Filed: Dec. 8, 2017

(65) Prior Publication Data

US 2019/0178555 A1 Jun. 13, 2019

(51) Int. Cl.
*F25D 11/02* (2006.01)
*F25D 23/02* (2006.01)
(Continued)

(52) U.S. Cl.
CPC ..... *F25D 11/02* (2013.01); *F25C 5/22* (2018.01); *F25D 23/028* (2013.01); *F25D 23/04* (2013.01);
(Continued)

(58) Field of Classification Search
CPC ..... F25D 11/02; F25D 23/028; F25D 23/04; F25D 23/063; F25D 2323/021; F25D 17/065; F25D 2400/04; F25D 23/025; F25D 23/066; F25D 23/067; F25D 2323/024; F25D 2400/06; F25D 2400/16; F25C 5/22
(Continued)

(56) References Cited

U.S. PATENT DOCUMENTS 2,692,809 A * 10/1954 Kesling ..... F25D 23/02 312/405
3,248,159 A * 4/1966 Hall ..... E05C 19/161 312/296
(Continued)

FOREIGN PATENT DOCUMENTS

FR 1281572 1/1962
JP 5461864 8/2004
(Continued)

OTHER PUBLICATIONS

International Search Report for PCT/US2018/064402, dated Mar. 19, 2019, 2 pages.

*Primary Examiner* — Paul Alvare
*Assistant Examiner* — Kirstin U Oswald
(74) *Attorney, Agent, or Firm* — Pearne & Gordon LLP

(57) ABSTRACT

A refrigerator appliance including a housing, a liner within the housing, a first door attached to the housing and pivotable about a vertical axis on one side of an opening to the compartment, and a second door attached to the housing and pivotable about a second vertical axis on an opposite side of the opening to the compartment. One of the first door and the second door includes a moveable mullion for sealing a gap between the first door and the second door when the first door and the second door are in a closed position. The moveable mullion includes a guide protrusion extending from one end thereof. The liner is configured to selectively receive one of a first guide plate and a second guide plate. Both the first guide plate and the second guide plate include a guide slot for receiving the guide protrusion of the moveable mullion.

15 Claims, 8 Drawing Sheets

(51) Int. Cl.
*F25D 23/04* (2006.01)
*F25D 23/06* (2006.01)
*F25C 5/20* (2018.01)
*F25D 17/06* (2006.01)

(52) U.S. Cl.
CPC ..... *F25D 23/063* (2013.01); *F25D 17/065* (2013.01); *F25D 2323/021* (2013.01); *F25D 2400/04* (2013.01)

(58) Field of Classification Search
USPC ..... 62/449
See application file for complete search history.

(56) References Cited

U.S. PATENT DOCUMENTS 3,601,463 A 8/1971 Watt
3,670,521 A 6/1972 Dodge et al.
3,674,359 A 7/1972 Crowe
3,834,177 A 9/1974 Scarlett
3,835,660 A 9/1974 Franck
3,872,688 A 3/1975 Tillman
3,984,223 A 10/1976 Whistler, Jr.
4,120,550 A 10/1978 Sherburn
4,288,135 A * 9/1981 Buchser ..... F25D 23/028 312/296
4,304,101 A 12/1981 Gidseg
4,428,096 A * 1/1984 Kaspar ..... E05D 11/105 16/335
4,467,618 A 8/1984 Gidseg
4,638,644 A 1/1987 Gidseg
4,711,098 A * 12/1987 Kuwabara ..... F25D 11/022 312/321.5
4,884,415 A * 12/1989 Mandel ..... F25D 21/04 62/277
5,411,328 A * 5/1995 You ..... F25D 23/028 312/405
5,694,789 A 12/1997 Do
5,720,536 A 2/1998 Jenkins et al.
6,019,447 A 2/2000 Jackovin
6,056,383 A * 5/2000 Banicevic ..... F25D 23/082 312/401
6,378,324 B1 * 4/2002 Percy ..... F25D 19/02 221/150 R
6,415,623 B1 7/2002 Jennings et al.
6,578,978 B1 * 6/2003 Upton ..... A47F 3/001 362/125
6,926,379 B1 8/2005 Grace et al.
7,008,032 B2 3/2006 Chekal et al.
7,410,229 B2 8/2008 Pohl et al.
7,410,230 B2 8/2008 Anderson et al.
7,490,916 B2 2/2009 Anderson et al.
7,726,756 B2 6/2010 Fu
8,167,389 B2 5/2012 Han et al.
8,292,383 B2 10/2012 Laible
8,398,186 B2 3/2013 Higami
8,511,766 B2 8/2013 Sonnenfroh et al.
8,764,133 B2 * 7/2014 Park ..... F25D 23/028 312/324
8,845,047 B2 9/2014 Luisi et al.
9,097,454 B2 8/2015 LeClear et al.
9,115,924 B2 8/2015 Leclear et al.
9,127,876 B2 9/2015 Wilson et al.
9,163,870 B2 * 10/2015 Jeon ..... F25D 23/00
9,429,357 B2 8/2016 Cha et al.
9,441,873 B1 9/2016 Drach et al.
9,726,423 B1 * 8/2017 Swarnkar ..... A47B 96/16
9,841,225 B2 * 12/2017 Almeida ..... F25D 23/087
2005/0046319 A1 * 3/2005 Chekal ..... F25D 11/02 312/401
2009/0273264 A1 * 11/2009 Butler ..... F25D 23/028 312/405
2009/0290992 A1 11/2009 Long
2009/0320509 A1 * 12/2009 Gorz ..... F25D 23/02 62/264
2011/0083465 A1 * 4/2011 Kim ..... F25D 23/028 62/449
2012/0073321 A1 3/2012 Davis
2014/0268648 A1 * 9/2014 Gomes ..... F21V 33/0044 362/94
2015/0015133 A1 * 1/2015 Carbajal ..... A47F 3/04 312/405
2016/0102905 A1 4/2016 Cha
2016/0178268 A1 * 6/2016 Jung ..... E05F 1/10 312/404
2016/0252294 A1 9/2016 Cha
2016/0265837 A1 9/2016 Bhatt
2016/0298895 A1 10/2016 Drach

FOREIGN PATENT DOCUMENTS

KR 100903976 10/2010
WO 2012123035 9/2012
WO WO-2012123035 A1 * 9/2012 ..... F25D 23/028

* cited by examiner

MODULAR FLIPPER MULLION RECEIVER

FIELD OF THE INVENTION

This application relates generally to a flipper mullion for a refrigeration appliance, and more particularly, to a refrigeration appliance including a flipper mullion receiver for actuating a flipper mullion attached to a door of a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Many modern refrigerators use a pair of French-style doors wherein two opposing doors allow access to the compartment. A rotatable flipper mullion is attached to one of the opposing doors for closing a gap between the doors and defining a sealing surface for the doors. A component is used for actuating a flipper mullion between opposing French doors of a refrigerated chamber.

BRIEF SUMMARY OF THE INVENTION

In accordance with one aspect, there is provided a refrigeration appliance including a housing; a liner within the housing defining a compartment for storing food items in a refrigerated environment; a first door attached to the housing and pivotable about a vertical axis on one side of an opening to the compartment; and a second door attached to the housing and pivotable about a second vertical axis on an opposite side of the opening to the compartment. One of the first door and the second door includes a moveable mullion for sealing a gap between the first door and the second door when the first door and the second door are in a closed position. The moveable mullion includes a guide protrusion extending from one end thereof wherein the liner is configured to selectively receive one of a first guide plate and a second guide plate. Both the first guide plate and the second guide plate include a guide slot for receiving the guide protrusion of the moveable mullion. When the first guide plate is attached to the liner a receiving opening of the guide slot is disposed a first distance from a plane bisecting the compartment into two equal side-by-side halves. When the second guide plate is attached to the liner a receiving opening of the guide slot is disposed a second distance from the plane bisecting the compartment into two equal side-by-side halves.

In accordance with another aspect, there is provided refrigerator appliance including a housing and a liner within the housing defining a compartment for storing food items in a refrigerated environment. The liner being configured to selectively receive one of a dual door assembly and a drawer assembly. The dual door assembly including a first door attached to the housing and pivotable about a vertical axis on one side of an opening to the compartment; and a second door attached to the housing and pivotable about a second vertical axis on an opposite side of the opening to the compartment. One of the first door and the second door including a moveable mullion for sealing a gap between the first door and the second door when the first door and the second door are in a closed position. The moveable mullion includes a guide protrusion extending from one end thereof. The liner is configured to selectively receive one of a first guide plate and a second guide plate. Both the first guide plate and the second guide plate include a guide slot for receiving the guide protrusion of the moveable mullion. When the first guide plate is attached to the liner a receiving opening of the guide slot is disposed a first distance from a plane bisecting the compartment into two equal side-by-side halves. When the second guide plate is attached to the liner a receiving opening of the guide slot is disposed a second distance from the plane bisecting the compartment into two equal side-by-side halves. The drawer assembly includes a drawer body movable relative to the compartment wherein the liner is configured to receive a cover plate that is free of a guide slot.

DESCRIPTION OF EXAMPLE EMBODIMENTS

Figure 1:
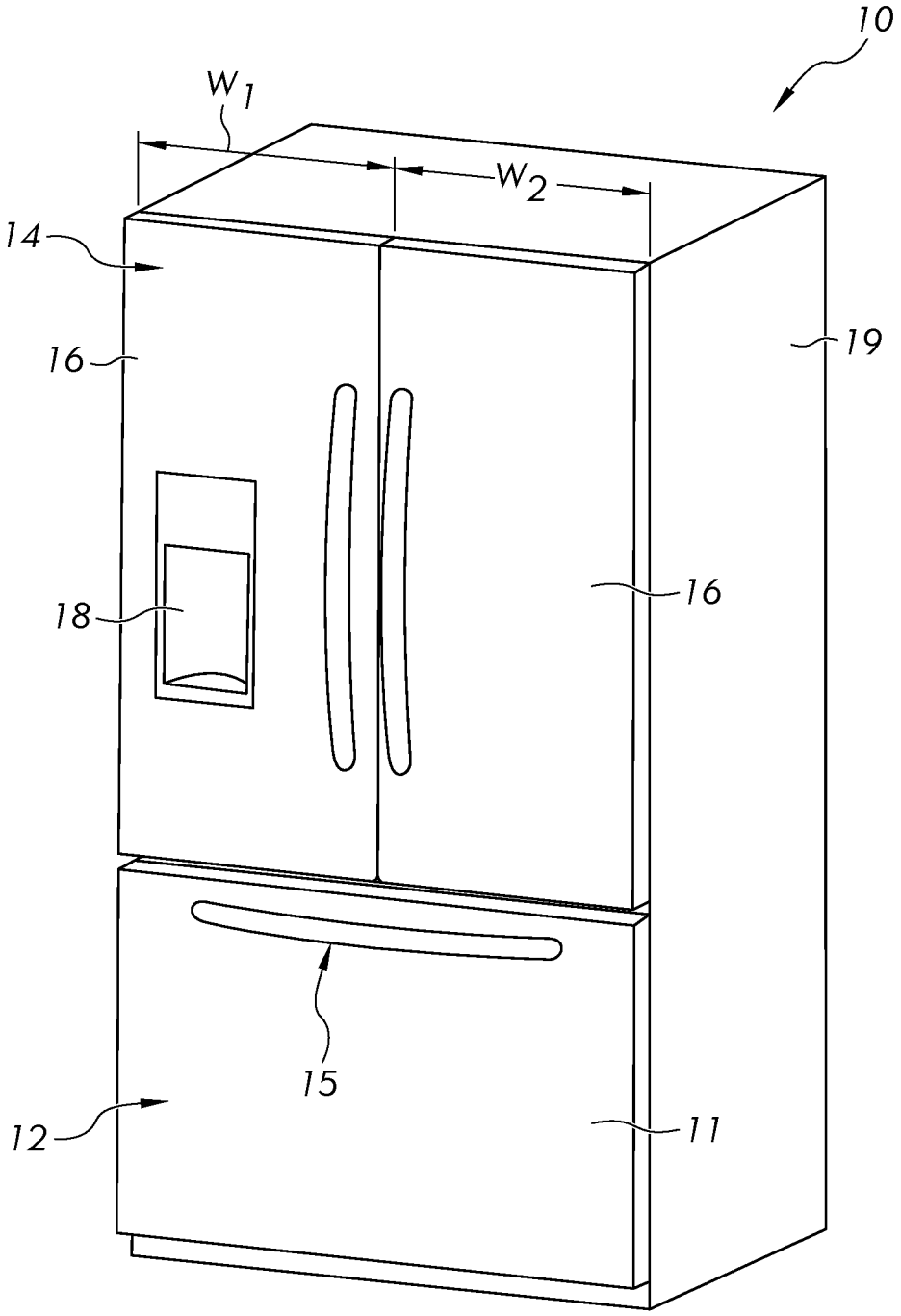
FIG. 1 is a front perspective view of a household French Door Bottom Mount refrigerator according to a first embodiment showing symmetrical doors of the refrigerator in a closed position.

An example apparatus will now be described more fully hereinafter with reference to the accompanying drawings in which embodiments of the disclosure are shown. Whenever possible, the same reference numerals are used throughout the drawings to refer to the same or like parts.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a standalone refrigerator or freezer, etc. wherein opposing doors 16 are used to close a compartment.

In FIG. 1, the freezer compartment 12 is arranged vertically beneath the fresh food compartment 14. The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

Figure 2:
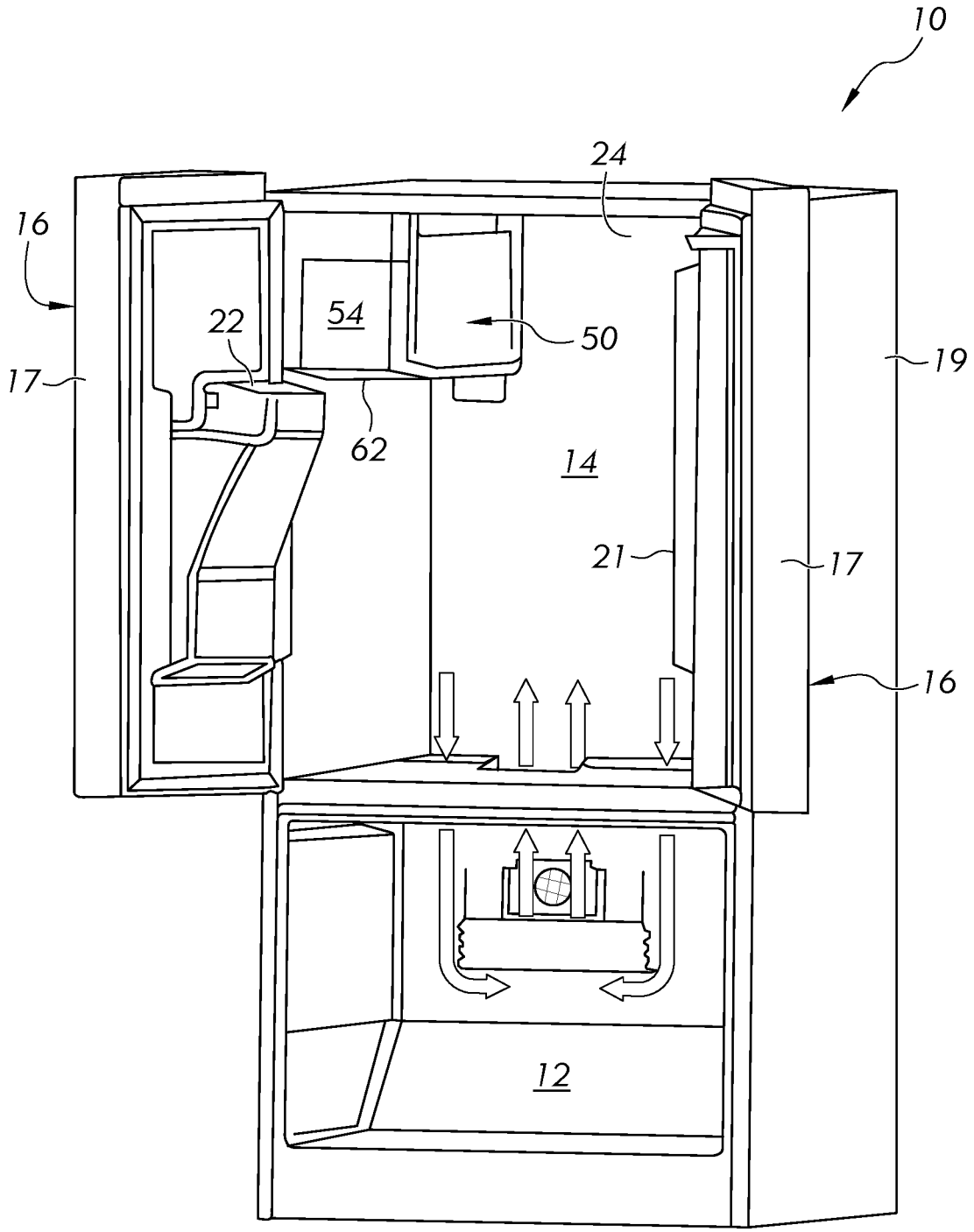
FIG. 2 is a front perspective view of the refrigerator of FIG. 1 showing the symmetrical doors in an opened position and an interior of a fresh food compartment.

Referring to FIG. 2, the refrigerator 10 includes an interior liner 24 that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator for the freezer compartment 12 can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 54 (FIG. 2) of an ice maker 50 disposed within the fresh food compartment 14. Ice pieces from the ice bin 54 can exit the ice bin 54 through an aperture 62 and be delivered to the dispenser 18 via an ice chute 22 (FIG. 2), which extends at least partially through the door 16 between the dispenser 18 and the ice bin 54.

In alternative embodiments, the ice maker is located within the freezer compartment. In this configuration, although still disposed within the freezer compartment 12, at least the ice maker (and possible an ice bin) is mounted to an interior surface of the freezer door. It is contemplated that the ice mold and ice bin can be separate elements, in which one remains within the freezer compartment 12 and the other is on the freezer door.

Figure 3:
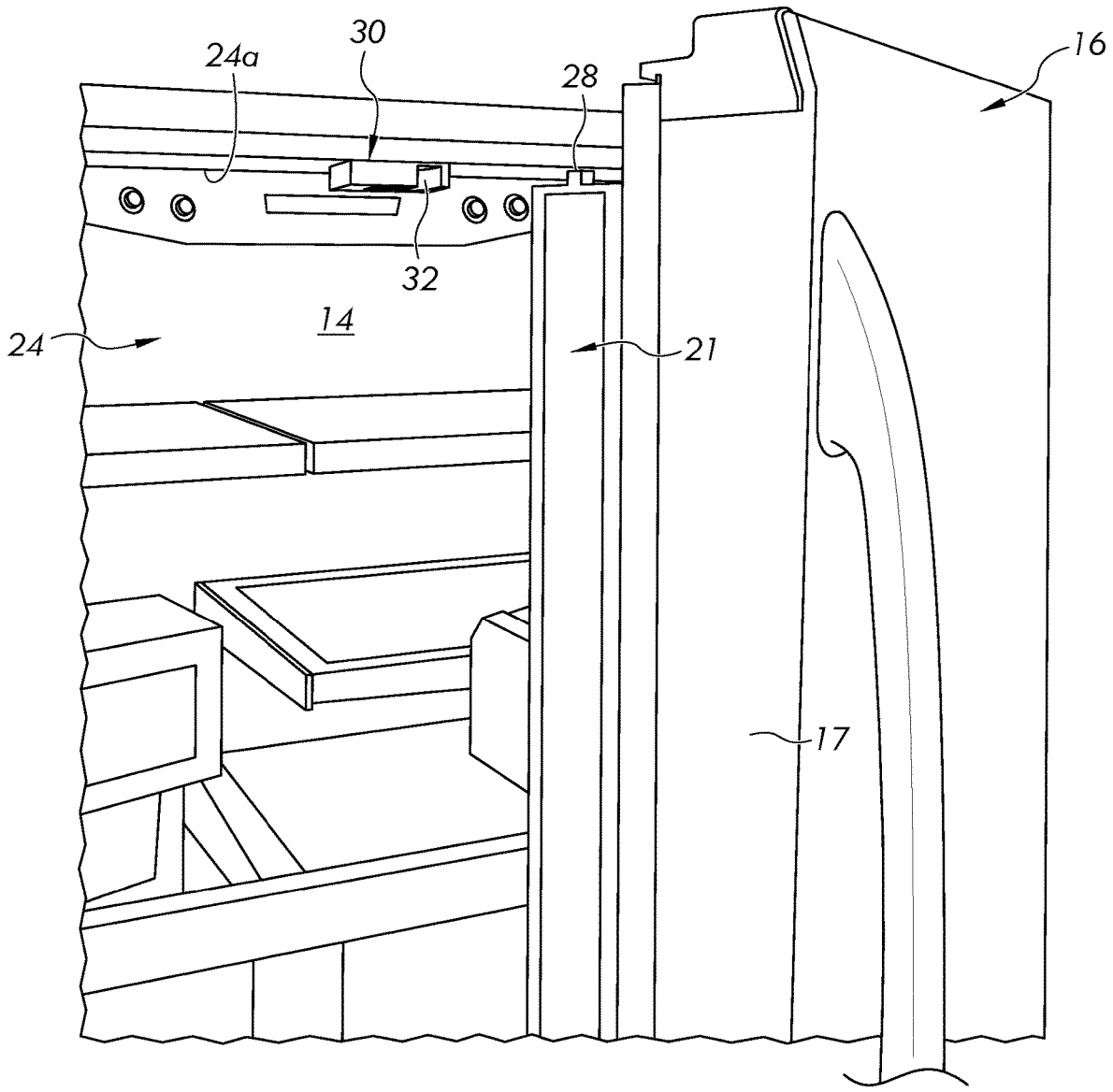
FIG. 3 is a partial front perspective view of a conventional French door refrigerator showing a flipper mullion and a fixed flipper mullion receiver.

Referring to FIG. 1, the doors 16 for closing the fresh food compartment 14 are pivotally coupled to a cabinet 19 of the refrigerator 10 to restrict and grant access to the fresh food compartment 14. The doors 16 are a pair of French-style doors 16 that collectively span the entire lateral distance of the entrance to the fresh food compartment 14 to enclose the fresh food compartment 14. Referring to FIGS. 2 and 3, a center flipper mullion 21 is pivotally coupled to at least one of the doors 16 to establish a surface against which a seal provided on the other one of the doors 16 can seal the entrance to the fresh food compartment 14 at a location between opposing side surfaces 17 of the doors 16. In FIGS. 2 and 3, the flipper mullion 21 is shown attached to the right door 16. It is contemplated that the flipper mullion 21 could be attached to the left door. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the flipper mullion 21 is substantially parallel to the door 16 when the flipper mullion 21 is in the first orientation, and forms an angle other than parallel relative to the door 16 when the flipper mullion 21 is in the second orientation, such as substantially perpendicular or other angle. The seal and the externally-exposed surface of the mullion 21 cooperate approximately midway between the lateral sides of the fresh food compartment 14.

Referring to FIG. 3, the rotatable flipper mullion 21 is positioned and dimensioned to engage a fixed mullion receiver 30 attached to an upper wall 24*a* of the liner 24. The flipper mullion 21 includes a pin or guide protrusion 28 that is configured to interface with a cam surface or guide slot 32 of the fixed mullion receiver 30. Similarly, another fixed mullion receiver (not shown) can be attached to a bottom of the fresh food compartment 14. As the door 16 is closed, the guide protrusion 28 of the flipper mullion 21 engages the guide slot 32, which causes the flipper mullion 21 to rotate to the first orientation via a cam operation, as described above. As the door 16 is opened, the guide protrusion 28 of the flipper mullion 21 interacts with the guide slot 32 such that the flipper mullion 21 is rotated to the second orientation.

Referring to FIG. 1, the refrigerator 10, accordingly to a first embodiment is a "symmetrical" refrigerator. "Symmetrical", means that the two refrigerator doors are the same width. In other words, the widths $W_1$ and $W_2$ for the doors 16 are equal.

Figure 4:
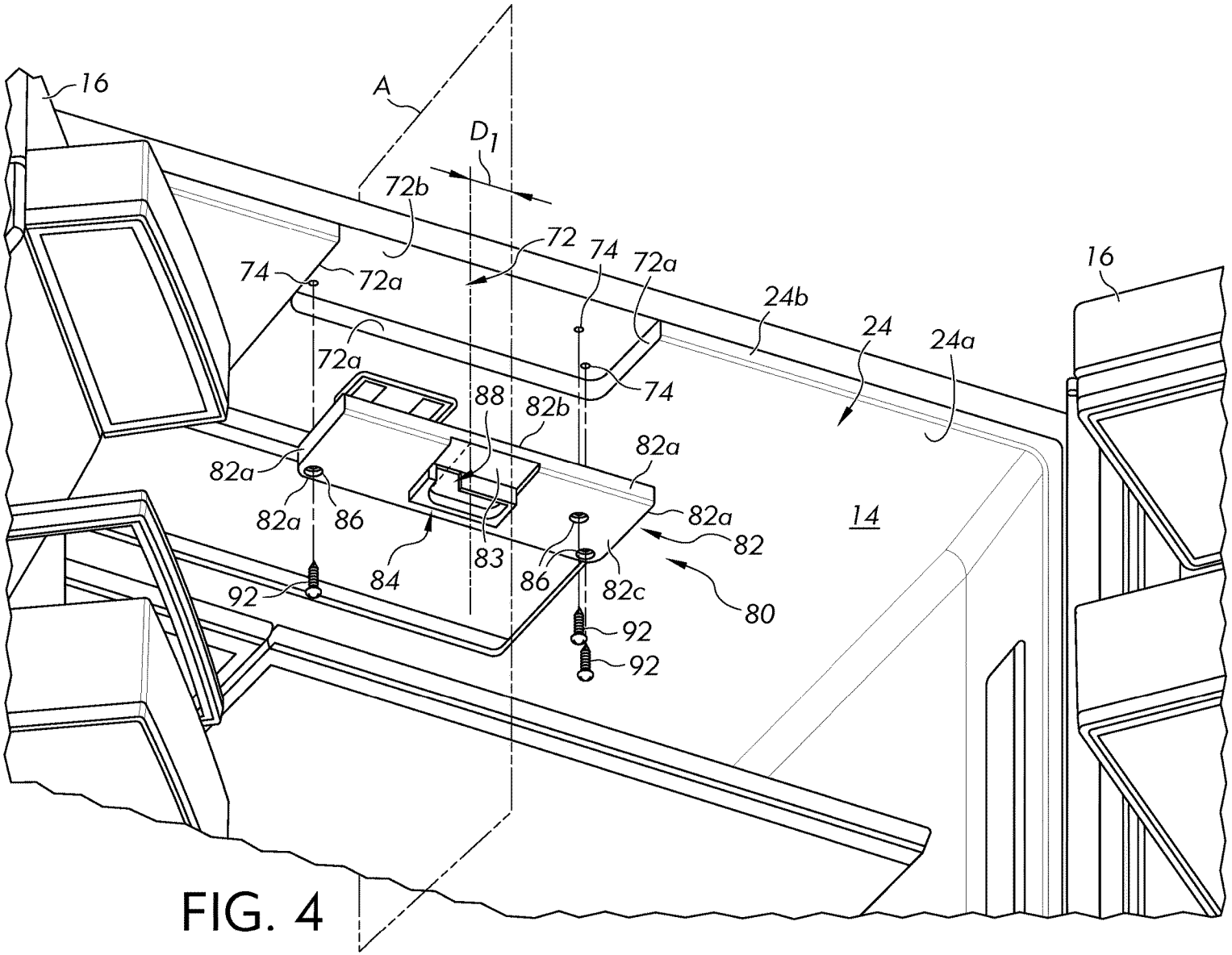
FIG. 4 is an enlarged exploded view of an upper wall of a liner for a fresh food compartment of the refrigerator shown in FIG. 2 showing a first embodiment of a modular flipper mullion receiver for the symmetrical doors.

FIG. 4 depicts an upper wall 24*a* of the liner 24 wherein a recess 72 is formed. The recess 72 is configured to receive a modular (e.g., interchangeable) flipper mullion receiver 80 (hereinafter referred to as the "mullion receiver 80"), as described in various embodiments in detail below. The recess 72 includes side walls 72*a* that surround a lowered surface 72*b*. It is contemplated that the side walls 72*a* can be perpendicular or angled relative to the surrounding portion of the upper wall 24*a*. The recess 72 shown is generally rectangular-in-shape with rounded corners and side walls 72*a* that are perpendicular relative to the surrounding portion of the upper wall 24*a*. It is contemplated that the recess 72 can have any other convenient outer profile for use in a domestic refrigerator, etc., circular, oblong, etc. that is aesthetically pleasing to a user. A plurality of mounting holes 74 extend through the recess 72 for mounting the mullion receiver 80 into the recess 72.

The mullion receiver 80 includes a body 82 and an arcuate shaped guide slot 84. The body 82 includes a plurality of holes 86 that are positioned and dimensioned as described below. The body 82 includes side peripheral walls 82*a*, an upper surface 82*b* and a lower surface 82*c*. The arcuate shaped guide slot 84 is positioned in the body 82. The guide slot 84 can be positioned in a recess 83 formed in the lower surface 82*c* or on the lower surface 82*c*. The guide slot 84 includes a receiving opening 88 that allows access to the inner side walls of the guide slot 84. In FIG. 4, the receiving opening 88 is positioned closer to the left door 16 to engage the flipper mullion (not shown) attached to the left door 16. It is contemplated that if the flipper mullion (not shown) is attached to the right door 16 that the receiving opening 88 would be positioned closer to the right door 16. A plurality of holes 86 extend through the body 82 and are dimensioned and positioned as described in detail below. The receiving opening 88 is positioned and dimensioned as described below.

The mullion receiver 80 is positioned in the recess 72. The side walls 72*a* of the recess 72 are contoured to match an outer profile of the side peripheral walls 82*a* of the mullion receiver 80. In FIG. 4, the recess 72 and the body 82 of the mullion receiver 80 are illustrated as being rectangular-in-shape with vertical side walls. It is contemplated that the body 82 of the mullion receiver 80 could be slightly smaller than the recess 72. It is also contemplated that a thickness of the body 82 of the mullion receiver 80 can be equal to a depth of the recess 72 such that the mullion receiver 80 is flush with the upper wall 24*a*. In the embodiment shown, the recess 72 has three side walls 72*a* and an open end. The mullion receiver 80 is positioned in the recess 72 such that one of the side peripheral walls 82*a* of the mullion receiver 80 is flush with a corresponding front lip portion 24*b* of the upper wall 24*a* of the liner 24. The plurality of holes 86 in the mullion receiver 80 are positioned and dimensioned to align with the plurality of mounting holes 74 in the recess 72. A plurality of fasteners 92, e.g., screws, bolts, etc. extend through the plurality of holes 86 and into the plurality of mounting holes 74 to secure the mullion receiver 80 into the recess 72.

In the embodiment shown, the mullion receiver 80 for the symmetrical refrigerator 10 (i.e., widths $W_1$ and $W_2$ for the doors 16 are equal) is dimensioned and positioned in the recess 72 such that the receiving opening 88 to the guide slot 84 is a first distance $D_1$ from a plane "A" bisecting the fresh food compartment 14 into two equal side-by-side halves. As described in detail above, the receiving opening 88 of the guide slot 84 is positioned and dimensioned to receive the guide protrusion 28 (FIG. 3) on the flipper mullion 21.

Figure 5:
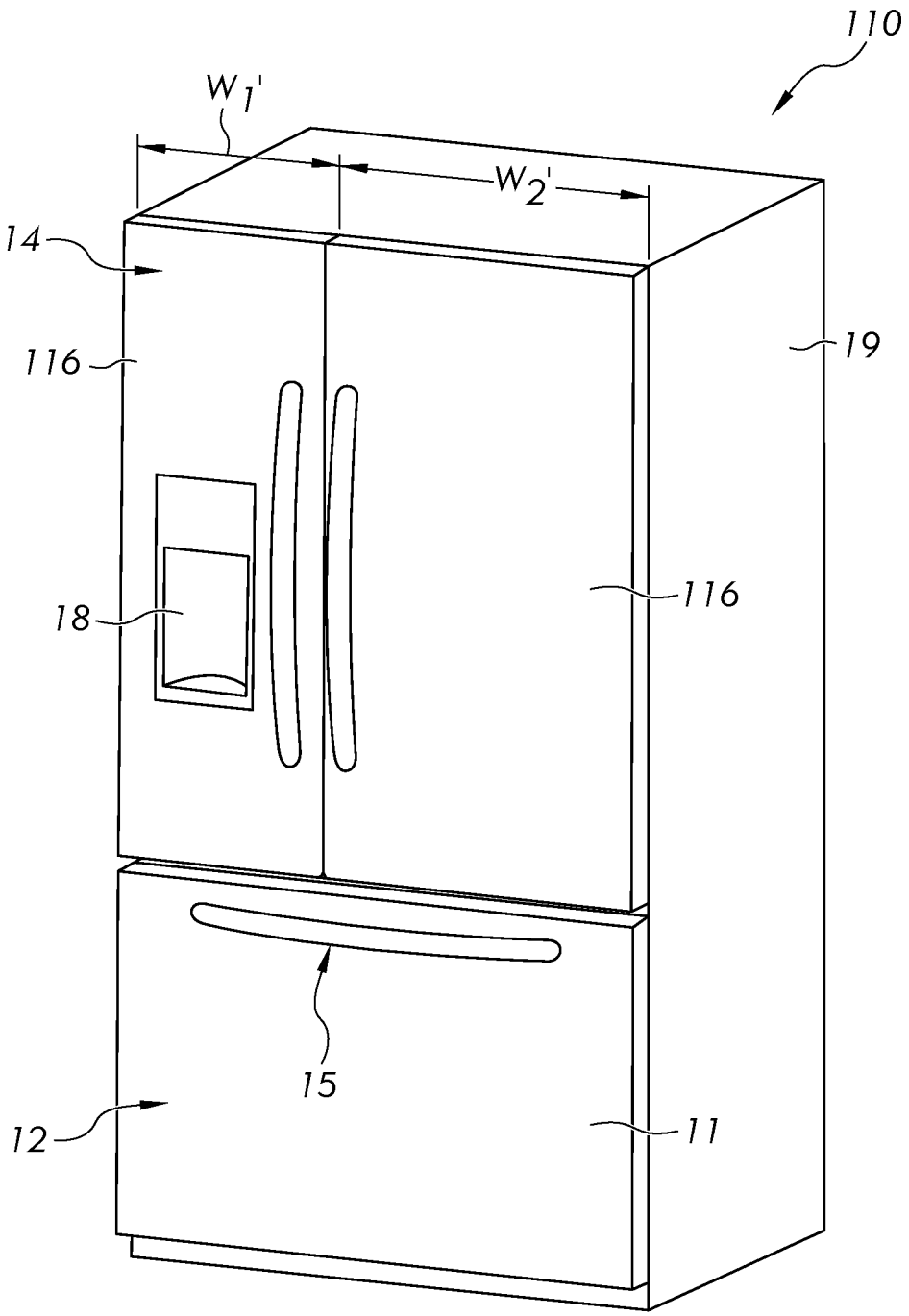
FIG. 5 is a front perspective view of a household French Door Bottom Mount refrigerator according to a second embodiment showing asymmetrical doors of the refrigerator in a closed position.
Figure 6:
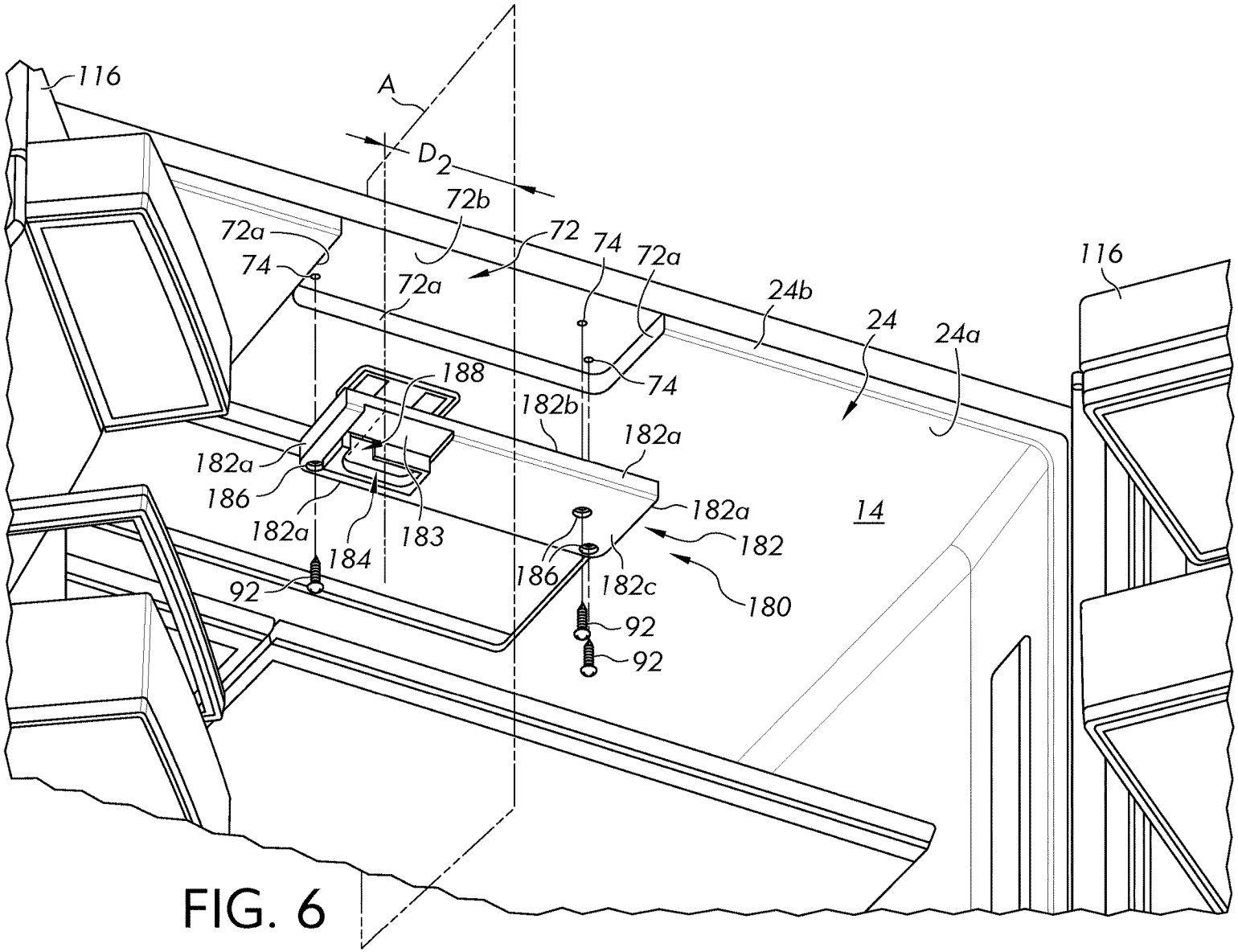
FIG. 6 is an enlarged exploded view of an upper wall of a liner for a fresh food compartment of the refrigerator shown in FIG. 5 showing a second embodiment of a modular flipper mullion receiver for the asymmetrical doors.

In a second embodiment, FIGS. 5 and 6 show an asymmetrical refrigerator 110. "Asymmetrical", means that two adjacent refrigerator doors 116 of the refrigerator 110 have different widths $W_1'$, $W_2'$. In FIG. 5, the width $W_1'$ is less than the width $W_2'$ such that the left door 116 is narrower than the right door 116. It is contemplated that the $W_1'$ can be greater than the width $W_2'$ (not shown) such that the left door 116 is wider than the right door 116. The components of the asymmetrical refrigerator 110 that are identical to the components of the symmetrical refrigerator 10 are referenced with the same reference number and are not described in detail below.

Referring to FIG. 6, the asymmetrical refrigerator 110 includes a second modular flipper mullion receiver 180 (hereinafter referred to as the second mullion receiver 180). Similar to the mullion receiver 80, the second mullion receiver 180 includes a body 182 and an arcuate shaped guide slot 184. The body 182 includes a plurality of holes 186 that are positioned and dimensioned as described below. The body 182 includes side peripheral walls 182*a*, an upper surface 182*b* and a lower surface 182*c*. The arcuate shaped guide slot 184 is positioned in the body 182 and is positioned and oriented for engagement with a flipper mullion on either the left or right door, as appropriate. It is contemplated that the guide slot 184 can be positioned in a recess 183 formed in the lower surface 182*c* or on the lower surface 182*c*. The guide slot 184 includes a receiving opening 188 that allows access to the inner side walls of the guide slot 184. The receiving opening 188 is positioned and dimensioned as described below.

The second mullion receiver 180 is positioned in the recess 72. The side walls 72*a* of the recess 72 are contoured to match an outer profile of the side peripheral walls 182*a* of the second mullion receiver 180. In FIG. 6 both the recess 72 and the body 182 of the second mullion receiver 180 are rectangular-in-shape with vertical side walls. It is contemplated that the body 182 of the second mullion receiver 180 could be slightly smaller than the recess 72. It is also contemplated that a thickness of the body 182 of the second mullion receiver 180 can be equal to a depth of the recess 72 such that the second mullion receiver 180 is flush with the upper wall 24*a*. In the embodiment shown, the recess 72 has three side walls 72*a* and an open end. The second mullion receiver 180 is positioned in the recess 72 such that one of the side peripheral walls 82*a* of the second mullion receiver 180 is flush with a corresponding front lip portion 24*b* of the upper wall 24*a* of the liner 24. The plurality of holes 186 in the second mullion receiver 180 are positioned and dimensioned to align with the plurality of mounting holes 74 in the recess 72. A plurality of fasteners 92, e.g., screws, bolts, etc. extend through the plurality of holes 86 and into the plurality of mounting holes 74 to secure the mullion receiver 80 into the recess 72.

In the embodiment shown, the second mullion receiver 180 for the asymmetrical refrigerator 110 is dimensioned and positioned in the recess 72 such that the receiving opening 188 to the guide slot 184 is a second distance $D_2$ from the plane "A" bisecting the fresh food compartment 14 into two equal side-by-side halves. The receiving opening 188 of the second mullion receiver 180 is positioned such that the second distance $D_2$ is greater than the distance $D_1$ for the mullion receiver 80 to accommodate the asymmetrical refrigerator door configuration. As described in detail above, the receiving opening 188 of the guide slot 184 is positioned and dimensioned to receive the guide protrusion 28 (FIG. 3) on the flipper mullion 21. It is contemplated that a single liner 24 can be used for both the symmetrical refrigerator 10 and the asymmetrical refrigerator 110.

Thus, as can be seen by the foregoing description, recess 72 is configured to receive a selected one of the modular flipper mullion receiver 80, 180 as suitable for refrigerator doors in a symmetrical or asymmetrical configuration. Preferably, both of the flipper mullion receivers 80, 180 have the same profile, major dimensions and fastener locations so that they are interchangeable within the same recess 72. In this manner, the refrigerator appliance architecture, manufacturing, and service are all simplified in that a single liner can be commonly used to define the refrigerated compartment regardless of whether the refrigerator appliance will be configured for symmetrical or asymmetrical doors.

Figure 7A:
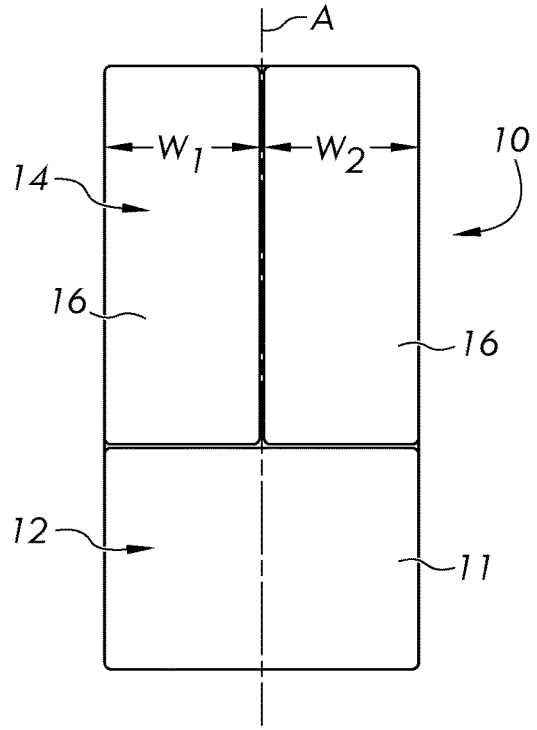
FIGS. 7A-7D illustrate various embodiments of the symmetrical and asymmetrical refrigerators shown in FIGS. 1 and 5.
Figure 7B:
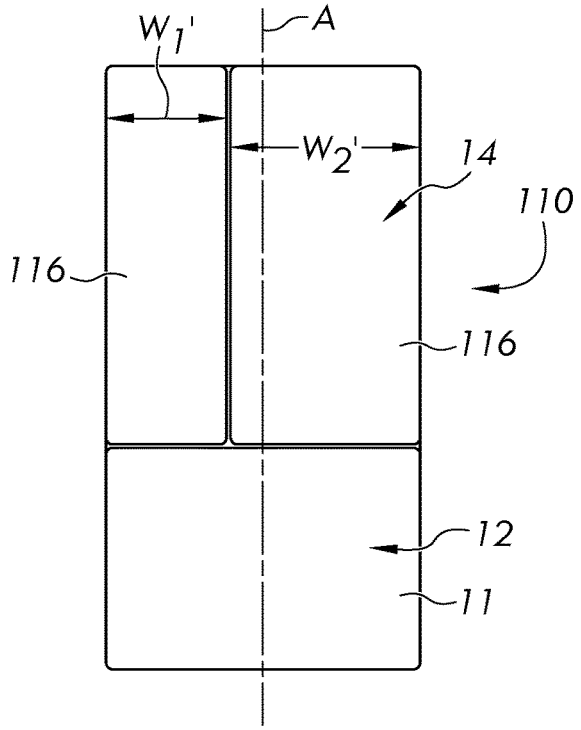

FIGS. 7A-7D illustrate various embodiments of the symmetrical refrigerator 10 and the asymmetrical refrigerator 110. In FIGS. 7A and 7B the symmetrical refrigerator 10 and the asymmetrical refrigerator 110 both include a single freezer door 11. The freezer door 11 is connected to a drawer assembly (not shown) including one or more freezer baskets (not shown) that can be withdrawn from the freezer compartment 12. Optionally, the single freezer door 11 could be a pilotable door. The plane "A" is shown in FIGS. 7A and 7B to illustrate the width $W_1$ and $W_2$ of the symmetrical doors 16 and the width $W_1'$ and $W_2'$ of the asymmetrical doors 116 relative to the plane "A" bisecting the refrigerated compartment.

Figure 7C:
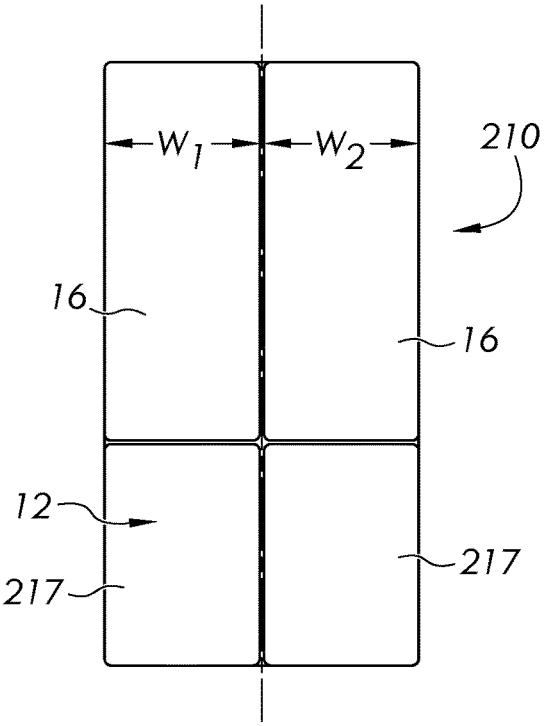
Figure 7D:
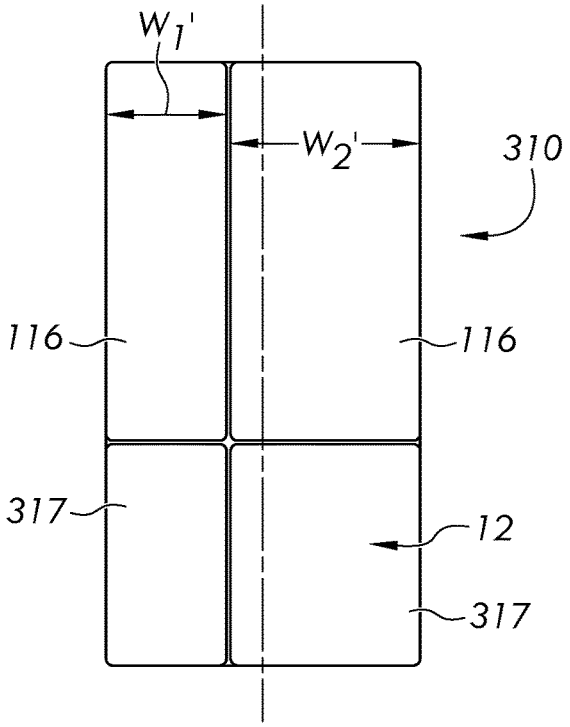

In other embodiments shown in FIGS. 7C and 7D, the symmetrical refrigerator 210 and the asymmetrical refrigerator 310 both include French-style doors 217, 317 for freezer compartment 12. As can be appreciated, the doors 217, 317 can be pivotally attached to the refrigerated appliance, similar to the doors 16, 116 previously described herein. Aside for differing widths, the doors 217 are essentially identical to the doors 317 and only the doors 317 will be described in detail below.

The doors 317 are similar to the doors 11 described in detail above. The doors 317 collectively span the entire lateral distance of the entrance to the freezer compartment 12 to enclose the freezer compartment 12. Similar to the doors 11, one of the doors 317 includes a center flip mullion (not shown) to establish a surface against which a seal provided on the other one of the doors 317 can seal the entrance to the freezer compartment 12 at a location between opposing side surfaces of the doors 317.

Figure 8:
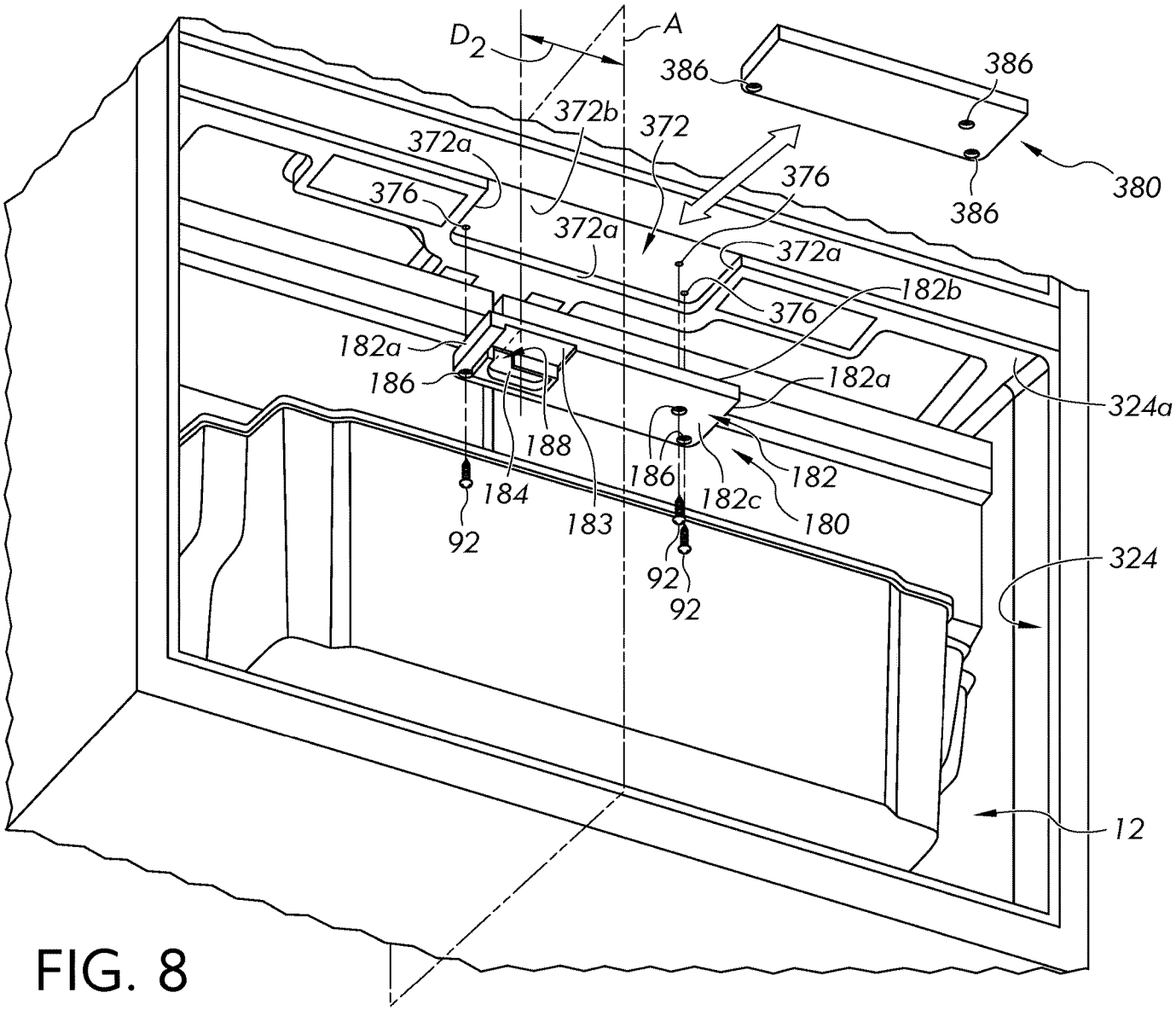
FIG. 8 is an enlarged exploded view of an upper wall of a liner for a freezer compartment of the refrigerator shown in FIG. 5 showing the second modular flipper mullion receiver of FIG. 6 and an optional cover plate for asymmetrical doors of a freezer compartment shown in FIG. 7D.

Referring to FIG. 8, an upper wall 324*a* of a liner 324 for the freezer compartment 12 is shown. A recess 372 is formed in the upper wall 324*a* and is configured to receive a mullion receiver for symmetrical doors 217 (e.g., the mullion receiver 80 (FIG. 4)), or a mullion receiver for asymmetrical doors 317 (e.g., the second mullion receiver 180 (FIG. 6)), or a cover plate 380 (FIG. 8). The recess 372 is similar to the recess 72 and includes side walls 372*a* that surround a lowered surface 372*b*. Preferably, all of the mullion receivers 80, 180 and cover plate 380 have the same profile, major dimensions and fastener locations so that they are interchangeable within the same recess 72, 372 in all refrigerated compartments. Optionally, in another example, the mullion receivers 80, 180 and/or cover plate 380 may have different major dimensions between those intended to be used in the fresh food compartment and those intended to be used in the freezer compartment so that they are not interchangeable between such compartments if the doors and/or flipper mullion architecture is likewise different between such compartments. It is contemplated that the side walls 372*a* can be perpendicular or angled relative to the surrounding portion of the upper wall 324*a*. In FIG. 8 the recess 372 is generally rectangular-in-shape with rounded corners and side walls 372*a* that are perpendicular relative to the surrounding portion of the upper wall 324*a*. A plurality of mounting holes 376 extend through the recess 372 for mounting the mullion receiver 80, the second mullion receiver 180 or the cover plate 380 into the recess 372. Preferably, the locations of the mounting holes are uniform among the receivers and cover plate so that they are interchangeable.

The cover plate 380, as will be described below, is intended to be used in a compartment that does not have a flipper mullion. In other words, the cover plate 380 acts as a "blank" that does not have a guide slot or receiving opening. The cover plate 380 includes a body that is dimensioned and contoured to be received into the recess 372. A plurality of holes 386 extend through the cover plate 380. The plurality of holes 386 are positioned and dimensioned to align with the plurality of mounting holes 376 in the recess 372.

FIG. 8 illustrates the second mullion receiver 180 and the cover plate 380 alternately positioned in the recess 372 (i.e., although both are shown for illustrative purposes, only a selected one is actively used). The plurality of fasteners 92 are provided for securing the second mullion receiver 180 or the cover plate 380 into the liner 324. In embodiments wherein the freezer compartment 12 is closed by the door 11 without any flipper mullion, the cover plate 380 is positioned in the recess 372. In the embodiments wherein the freezer compartment 12 is closed by a pair for French-style doors 217, 317, either the mullion receiver 80 (for a symmetrical refrigerator) or the second mullion receiver 180 (for an asymmetrical refrigerator) is positioned in the recess 372. As such, a single liner 324 can be used for the freezer compartment 12, regardless of whether the refrigerator is symmetrical or asymmetrical or whether French-style doors or a drawer assembly is provided to seal the freezer compartment 12.

The mullion receiver 80, the second mullion receiver 180 and the cover plate 380 are shown attached to the upper wall 24*a*, 324*a* of the liners 24, 324. It is contemplated that these receivers 80, 180 and the cover plate 380 can optionally be attached to a bottom wall (not shown) of the liners 24, 324 or some combination of receivers 80, 180 and the cover plate 380 can be attached to the upper wall 24*a*, 324*a* and the bottom wall of the liners 24, 324.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator appliance comprising:

a housing;

a liner within the housing defining a compartment for storing food items in a refrigerated environment;

a first door attached to the housing and pivotable about a vertical axis on one side of an opening to the compartment;

a second door attached to the housing and pivotable about a second vertical axis on an opposite side of the opening to the compartment, one of the first door and the second door including a moveable mullion for sealing a gap between the first door and the second door when the first door and the second door are in a closed position, the moveable mullion including a guide protrusion extending from one end thereof, a first guide plate including a guide slot for receiving the guide protrusion of the movable mullion, and a second guide plate including a guide slot for receiving the guide protrusion of the movable mullion, wherein the first guide plate and the second guide plate are not attached to the liner at the same time such that the guide protrusion is received into only one of the guide slot of the first guide plate or the guide slot of the second guide plate, wherein when only the first guide plate is attached to the liner, a receiving opening of the guide slot is disposed a first distance from a plane bisecting the compartment into two equal side-by-side halves, and when only the second guide plate is attached to the liner, a receiving opening of the guide slot is disposed a second distance from the plane bisecting the compartment into two equal side-by-side halves.

2. The refrigerator appliance according to claim 1, wherein the compartment is a fresh food compartment maintained at temperatures above 0° C.

3. The refrigerator appliance according to claim 1, wherein the compartment is a freezer compartment maintained at temperatures below 0° C.

4. The refrigerator appliance according to claim 1, wherein a recess is formed in the liner for selectively receiving said one of the first guide plate and the second guide plate.

5. The refrigerator appliance according to claim 4, wherein an outer profile of the recess corresponds to outer profiles of the first guide plate and the second guide plate.

6. The refrigerator appliance according to claim 1, wherein a width of the first and second doors are either symmetrical or asymmetrical, and the first distance is less than the second distance.

7. The refrigerator appliance according to claim 1, wherein the first guide plate and the second guide plate are selectively attached to a bottom wall of the liner.

8. The refrigerator appliance according to claim 1, wherein the first guide plate and the second guide plate are selectively attached to a top wall of the liner.

9. A refrigerator appliance comprising:

a housing;

a liner within the housing defining a compartment for storing food items in a refrigerated environment;

wherein the liner is configured to selectively receive one of a dual door assembly and a drawer assembly, the dual door assembly including:

a first door attached to the housing and pivotable about a vertical axis on one side of an opening to the compartment;

a second door attached to the housing and pivotable about a second vertical axis on an opposite side of the opening to the compartment, one of the first door and the second door including a moveable mullion for sealing a gap between the first door and the second door when the first door and the second door are in a closed position, the moveable mullion including a guide protrusion extending from one end thereof, a first guide plate including a guide slot for receiving the guide protrusion of the movable mullion, and a second guide plate including a guide slot for receiving the guide protrusion of the movable mullion, wherein the first guide plate and the second guide plate are not attached to the liner at the same time such that the guide protrusion is received into only one of the guide slot of the first guide plate or the guide slot of the second guide plate, wherein when only the first guide plate is attached to the liner, a receiving opening of the guide slot is disposed a first distance from a plane bisecting the compartment into two equal side-by-side halves, and when only the second guide plate is attached to the liner, a receiving opening of the guide slot is disposed a second distance from the plane bisecting the compartment into two equal side-by-side halves; and the drawer assembly including:

a drawer body movable relative to the compartment, wherein the liner is configured to receive a cover plate that is free of a guide slot.

10. The refrigerator appliance according to claim 9, wherein the compartment is a freezer compartment maintained at temperatures below 0° C.

11. The refrigerator appliance according to claim 9, wherein a recess is formed in the liner for selectively receiving one of the first guide plate, the second guide plate and the cover plate.

12. The refrigerator appliance according to claim 11, wherein an outer profile of the recess corresponds to outer profiles of the first guide plate, the second guide plate and the cover plate so that they are interchangeably mounted within the recess.

13. The refrigerator appliance according to claim 9, wherein the first distance is less than the second distance.

14. The refrigerator appliance according to claim 9, wherein the first guide plate, the second guide plate and the cover plate are selectively attached to a bottom wall of the liner.

15. The refrigerator appliance according to claim 9, wherein the first guide plate, the second guide plate and the cover plate are selectively attached to a top wall of the liner.

* * * * *